US005682751A

United States Patent [19]

Langhorn et al.

[11] Patent Number: 5,682,751

[45] Date of Patent: Nov. 4, 1997

[54] DEMOUNTABLE THERMAL COUPLING AND METHOD FOR COOLING A SUPERCONDUCTOR DEVICE

[75] Inventors: Alan Robert Langhorn, Encinitas; Michael Heiberger, Del Mar, both of Calif.

[73] Assignee: General Atomics, San Diego, Calif.

[21] Appl. No.: 670,730

[22] Filed: Jun. 21, 1996

[51] Int. Cl.[6] ..... F25B 19/00

[52] U.S. Cl. ..... 62/51.1; 62/383; 62/55.5

[58] Field of Search ..... 62/51.1, 55.5, 62/383; 165/165, 185

[56] References Cited

U.S. PATENT DOCUMENTS

| | | | |
|---|---|---|---|
| 4,223,540 | 9/1980 | Longsworth | 62/514 R |
| 4,692,982 | 9/1987 | Rice | 29/402.09 |
| 4,723,873 | 2/1988 | Masznyik | 405/156 |
| 4,724,677 | 2/1988 | Foster | 62/55.5 |
| 4,763,483 | 8/1988 | Olsen | 62/55.5 |
| 4,956,974 | 9/1990 | Planchard et al. | 62/6 |
| 5,025,632 | 6/1991 | Spritzer | 62/64 |

*Primary Examiner*—Henry A. Bennett
*Assistant Examiner*—Pamela A. O'Connor
*Attorney, Agent, or Firm*—Nydegger & Associates

[57] ABSTRACT

A demountable thermal coupling for engaging a refrigeration unit with a cryogenic device includes a collet assembly which is slidingly mounted against a retainer ring in the passageway of a sleeve assembly. When the refrigeration unit is engaged with the sleeve assembly, the collet assembly closes onto a cooling probe of the refrigeration unit to establish a thermal contact between the cooling probe and the collet assembly. An interconnect between the collet and the superconducting device then allows the cooling probe to cool the superconducting device. Withdrawal of the cooling probe from the collet disengages the refrigeration unit from the superconducting device.

20 Claims, 1 Drawing Sheet

DEMOUNTABLE THERMAL COUPLING AND METHOD FOR COOLING A SUPERCONDUCTOR DEVICE

FIELD OF THE INVENTION

The present invention pertains generally to thermal couplings for refrigeration units. More specifically, the present invention pertains to a thermal coupling which easily engages and disengages a refrigeration unit and the device which is to be cooled. The present invention is particularly, but not exclusively, useful as a thermal coupling which allows for the cooling of cryogenic and superconducting devices to temperatures as low as four or five degrees Kelvin.

BACKGROUND OF THE INVENTION

It is well known that superconductivity is accomplished at extremely low temperatures. Even the so-called high temperature superconductors require temperatures which are as low as approximately twenty degrees Kelvin. Other superconductors, the not-so-high temperature superconductors, require temperatures which are as low as approximately four or five degrees Kelvin. There are numerous other specialized applications using cryogenic devices that require low temperatures, i.e., less than 100 degrees Kelvin. In any case, special refrigeration apparatus is required to attain these low temperatures.

Many apparatus which incorporate superconducting elements or other cryogenic devices have separate refrigeration units that need to be thermally coupled with the superconducting elements. Typically, such a coupling is accomplished using structures which permanently connect the refrigeration unit to the superconductor or cryogenic device. It happens, however, that there are several applications where it would be preferable if the refrigeration unit could be selectively demounted or disconnected from the cryogenic element. For instance, in devices which use superconductor coils for the purpose of periodically generating magnetic fields, the ability to disconnect a refrigeration device from the superconductor coil, and to subsequently reconnect them, can be both advantageous and desirable. The problem, of course, is that the connect/disconnect operation must not detract from the ability of the refrigeration unit to cool the device to very low temperatures.

For a thermal coupling, it is known that the efficacy of thermal transfer from one body to another body is a function of the pressure and the contact surface area between the two bodies. Thus, for a given contact surface area, the efficacy of heat transfer between two bodies is dependent on factors which include the force which each of the bodies exert on the other over their common contact surface area. The consequence of this is that a thermal coupling for the very low temperatures required by cryogenic devices such as superconductors must be capable of generating great pressures at the coupling interface. Further, to satisfy requirements mentioned above, this pressure must be generated by a coupling which can be easily connected and disconnected.

In light of the above, it is an object of the present invention to provide a demountable thermal coupling which effectively joins a refrigeration unit with a cryogenic device such as a superconductor to cool the device to a satisfactory operating temperature. Another object of the present invention is to provide a demountable thermal coupling which facilitates the connect/disconnect operation of joining or separating a refrigeration unit and a cryogenic device. It is another object of the present invention to provide a demountable thermal coupling which can adjust and maintain a predetermined pressure over the contact surface area between a refrigeration unit and a cryogenic device. Still another object of the present invention is to provide a demountable thermal coupling which is effectively easy to use, relatively simple to manufacture and comparatively cost effective.

SUMMARY OF THE PREFERRED EMBODIMENTS

A demountable thermal coupling in accordance with the present invention includes a collet assembly which clamps onto the cold end of a refrigeration unit. This clamping is caused only by the action of the refrigeration unit as it presses against the collet assembly. Once the refrigeration unit is engaged with the collet assembly, a cryogenic device connected to the collet assembly is then cooled by the refrigeration unit. Disengagement of the refrigeration unit from the coupling is accomplished by merely ceasing the pressing action of the refrigeration unit against the collet assembly.

For the present invention, the collet assembly is slidingly mounted in the passageway of a hollow cylindrical sleeve. This passageway is defined by the inner wall of the sleeve and its attached components, which act together both as a base on which the collet is mounted for support, and as a membrane which helps maintain a vacuum in the passageway.

With specific regard to the collet assembly itself, this component of the present invention includes a plate and a plurality of petals which are each fixedly attached to the plate. The petals extend from one side of the plate in a circular fashion and form a recess which is essentially defined by an inner surface of the collet. The collet also has an outer surface which is on the side of the petals away from the inner surface. Further, the plate of the collet assembly is attached to the sleeve in a manner which places the collet and its recess inside the passageway of the sleeve. More particularly, for this particular attachment, a bellows is used to interconnect the sleeve with the plate of the collet assembly so there can be some relative movement between the sleeve and the collet.

The thermal coupling of the present invention also includes a retainer ring which is positioned in the passageway between the components within the inner wall of the sleeve and the outer surface of the collet. The purpose of this retainer ring is to allow the collet to slide over the inner wall of the sleeve in the passageway. More specifically, the retainer ring has an inner edge and an outer edge with a plurality of channels that extend radially through the ring between the inner and the outer edges. A pair of counter-rotatable ball bearings are positioned in each of these channels, with one ball bearing extending therefrom for rolling contact with the inner wall of the sleeve and the other ball bearing extending therefrom for rolling contact with the outer surface of the collet.

In the operation of the demountable thermal coupling of the present invention, a tapered cooling probe of the refrigeration unit is inserted into the passageway of the sleeve and into the recess of the collet. The refrigeration unit is then structurally engaged, directly or indirectly, with the sleeve to generate a force between the cooling probe of the refrigeration unit and the collet of the demountable thermal coupling. In a manner well known in the art, this force between the refrigeration unit and the collet can be adjusted to some predetermined value. This is done by manipulation of the locking mechanism which engages the refrigeration unit to the sleeve. It then happens that, as the tapered cooling probe is urged into the collet recess and against the collet itself, the petals of the collet are caused to press against the probe with a mechanically amplified force. The pressure that is generated by this amplified force over the contact area between the probe and the collet establishes the required thermal coupling with minimized contact resistance. As indicated above, disengagement of the refrigeration unit from the superconductor device is accomplished merely by releasing the locking mechanism and withdrawing the cooling probe from the recess of the collet assembly.

In a preferred embodiment of the present invention, the cooling probe and the collet are made of copper. Additionally, the cooling probe and the inner surface of the collet are coated with a layer of indium in the contact surface area to enhance thermal transfer between the probe and the collet. Preferably this indium layer is approximately one thousandth of an inch thick.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DESCRIPTION OF THE PREFERRED EMBODIMENT

Figure 1:
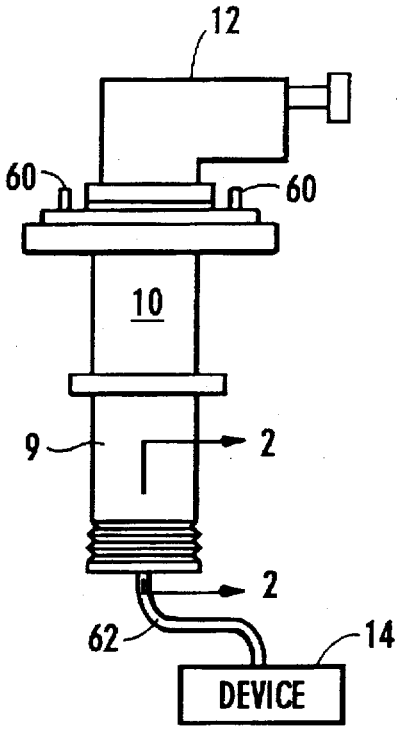
FIG. 1 is a front elevational view of the thermal coupling of the present invention shown with a refrigeration unit engaged to a cryogenic device through the coupling.

Referring initially to FIG. 1, a demountable thermal coupling according to the present invention is shown and generally designated 9. More specifically, the thermal coupling 9 is part of a cold sleeve assembly 10, and shown connecting a refrigeration unit 12 to a superconductor device 14. As intended for the present invention, the thermal coupling 9 is an easily operated means for thermally connecting the refrigeration unit 12 to the cryogenic device 14 and for disconnecting the unit 12 from the device 14. The structure and cooperation of structure which accomplishes these functions is best seen in FIG. 2.

Figure 2:
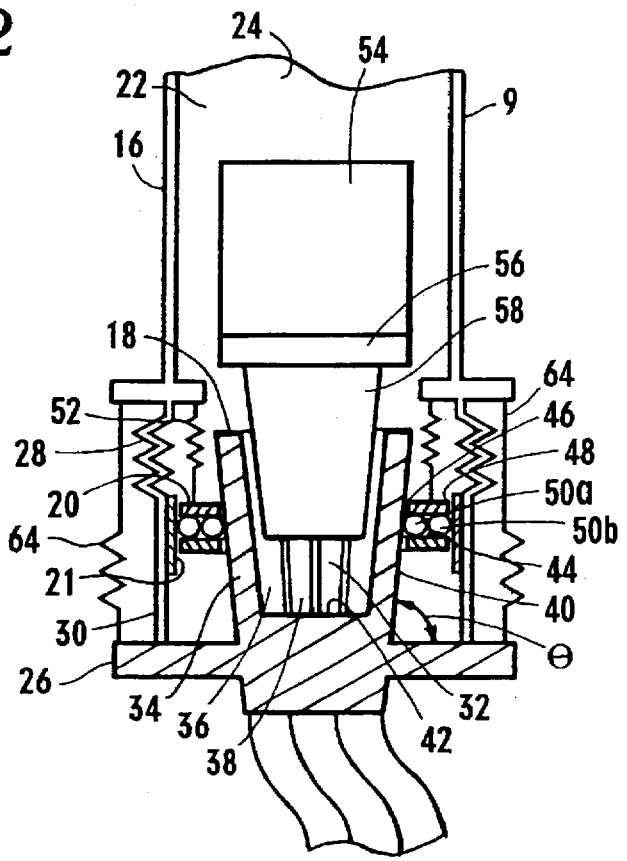
FIG. 2 is a cross sectional view of the thermal coupling as seen along the line 2—2 in FIG. 1.

In FIG. 2 it will be seen that the thermal coupling 9 essentially includes a sleeve 16, a collet assembly 18, a retainer ring 20 and a bearing ring 21. As shown, the sleeve 16 is preferably a hollow cylinder which is formed with a passageway 22 that is defined by the inner wall 24 of the sleeve 16. As also shown in FIG. 2, the collet assembly 18 includes a plate 26 which is connected via a tube 30 to a bellows 28. Bellows 28 is, in turn, connected to the sleeve 16. For reasons to be more fully appreciated in light of subsequent disclosure, the bellows 28 permit relative movement between the sleeve 16 and the collet assembly 18. Importantly, this movement is accomplished while maintaining a seal between the two structures that allows the sleeve 16 to act as a vacuum membrane to isolate the external environment from the cryogenic device 14.

The collet assembly 18 includes a plurality of petals 32 which extend at an angle θ from the plate 26. Together, the petals 32 create a collet 34 which has a recess 36 that is generally defined by an inner surface 38 of the collet 34. Collet 34 also has an outer surface 40 and a base surface 42 which is located at the bottom of the recess 36. Preferably, the collet assembly 18 is made of copper and the inner surface 38 is coated with a layer of indium which is approximately one thousandth of an inch thick.

FIG. 2 also shows that the retainer ring 20 is formed with a plurality of channels 44 which each extend radially through the ring 20 between an inner edge 46 and an outer edge 48. Additionally, it will be seen that retainer ring 20 includes a pair of ball bearings **50*a* and 50*b* which are juxtaposed in each of the channels 44. As specifically intended for the present invention, the combined diameters of the ball bearings 50*a* and 50*b* is greater than the length of a channel 44 in which they are juxtaposed. Consequently, when retainer ring 20 is positioned as shown between bearing ring 21 and petals 32, the ball bearing 50*a* is placed in contact with the outer surface 40 of collet 34. At the same time, the ball bearing 50*b* is placed in contact with the bearing ring 21 on inner wall 24 of sleeve 16. The retainer ring 20 is maintained in proper position in passageway 22 of sleeve 16 by a plurality of retainer ring springs 52. The collet assembly 18 is maintained in proper position with respect to the sleeve 16 by a plurality of collet springs 64 which interconnect the sleeve 16 with plate 26 of collet 18** substantially as shown.

By cross referencing FIG. 1 and FIG. 2, it will be appreciated that the refrigeration unit 12 includes an extension arm 54. For refrigeration units 12 which are useful with the coupling 9 of the present invention, the extension arm 54 will include what is generally termed a cold end 56. As shown in FIG. 2, a tapered cooling probe 58 extends from the cold end 56. Preferably, this cooling probe 58 is made of copper and is dimensioned compatibly with the angle θ of collet 34 so that the probe 58 can be easily received in the recess 36. Also, the copper cooling probe 58 is preferably coated with a layer of indium which, like the inner surface 38 of collet 34, is approximately one thousandth of an inch thick. Thus, over the entire surface area where probe 58 contacts collet 34, both structures are coated with indium to enhance their thermal contact.

In FIG. 1 it can be appreciated that the refrigeration unit 12 is joined with the demountable thermal coupling 9 by a plurality of locking mechanisms 60. More specifically, the unit 12 is joined, either directly or indirectly, to the sleeve 16 of coupling 9 by these mechanisms 60. As intended for the present invention, the mechanisms 60 can be of any type that are well known in the pertinent art which are adjustable to established a desired or predetermined force between the refrigeration unit 12 and the coupling 9. For instance, it is known that a spring-type mechanism is useful for this purpose. In any event, it is important that the force established by the locking mechanisms 60 between coupling 9 and refrigeration unit 12 be adjustable and controllable. This is so because this force will directly determine the resultant force which generates pressure between the probe 58 and the collet 34. In turn, this pressure between probe 58 and collet 34 will establish the efficacy of thermal conductivity for the coupling 9.

OPERATION

In the operation of the demountable thermal coupling 10 of the present invention, the tapered cooling probe 58 of refrigeration unit 12 is passed through the passageway 22 of sleeve 16 and is inserted into the recess 36 of collet 34. The locking mechanisms 60 are then manipulated to engage refrigeration unit 12 with coupling 9. More specifically, as indicated above, the actual engagement of unit 12 with coupling 9 is made with the sleeve 16.

As will be easily appreciated by the skilled artisan, when cooling probe 58 contacts collet 34, or the base surface 42 of collet 34, the contact force will cause the whole collet assembly 18 to be displaced in passageway 22 of sleeve 16. This movement of the collet assembly 18 will then cause retainer ring 20 to establish a reactive force against the outer surface 40 of collet 34. Due to the geometries involved in the construction of collet assembly 18, in general, the reactive force results from an amplification of the contact force by a factor which is inversely proportional to the cosine of the angle θ. This beneficially results in increased pressure by the petals 32 of collet 34 against the tapered cooling probe 58.

With the reduced contact resistance made possible by the high pressure generated between probe 58 and collet 34, the connectors 62 which interconnect plate 26 of collet assembly 18 with the thermal bus of cryogenic device 14 can be effective in keeping the device 14 at a desired low temperature.

While a contact force in a direction which urges the probe 58 against collet 34 is effective for establishing a thermal coupling 9, there is no force other than the forces controlled by mechanisms 60 which prevent a disengagement or disconnect between the probe 58 and the collet 34. Consequently, demounting the refrigeration unit 12 from the superconductor device 14 merely requires loosening and disengaging the mechanisms 60.

Upon demounting, the collet assembly 18 is reset to its original position by the force exerted thereon from the collet springs 64.

What is claimed is:

1. A demountable thermal coupling for engaging a refrigeration unit having a cooling probe with an electrical superconducting device which comprises:

a collet assembly formed with a recess;

a sleeve assembly formed with a passageway for receiving said collet assembly therein;

means for slidingly mounting said collet assembly in said passageway of said sleeve assembly;

means for engaging said refrigeration unit with said sleeve assembly to urge said probe into said recess of said collet to close said collet onto said probe to establish thermal contact therebetween; and means for thermally connecting said collet with said superconducting device.

2. A coupling as recited in claim 1 wherein said collet assembly comprises:

a plate; and a plurality of petals, each said petal being fixedly attached to said plate to establish a collet having an inner surface and an outer surface, said inner surface of said collet defining said recess.

3. A coupling as recited in claim 2 wherein said sleeve is cylindrically shaped and has a first end and a second end with an inner wall extending therebetween to define said passageway and wherein said coupling further comprises a retainer ring slidingly mounted on said inner wall of said sleeve for sliding contact with said outer surface of said collet.

4. A coupling as recited in claim 3 wherein said retainer ring has an outer edge and an inner edge and is formed with a plurality of channels extending radially therethrough between said outer edge to said inner edge, and wherein said retainer ring further comprises a pair of juxtaposed counter-rotatable ball bearings, one said pair of ball bearings being rotatably mounted in each said channel of said retainer ring with one ball bearing extending beyond said outer edge of said retainer ring for contact with said inner wall of said sleeve and one ball bearing extending beyond said inner edge of said retainer ring for contact with said outer surface of said collet.

5. A coupling as recited in claim 4 further comprising a spring mechanism interconnecting said retainer ring with said sleeve for aligning said retainer ring on said inner wall of said sleeve.

6. A coupling as recited in claim 5 further comprising means attached to said refrigeration unit for engaging said refrigeration unit with said sleeve to urge said cooling probe of said refrigeration unit into said recess of said collet with a predetermined force.

7. A coupling as recited in claim 6 wherein said cooling probe is tapered and said collet are made of copper and wherein said tapered cooling probe and said inner surface of said collet are plated with a layer of indium approximately one one thousandths of an inch thick (0.001 inch).

8. A demountable thermal coupling for engaging a refrigeration unit with an electrical superconducting device which comprises:

a collet forming a recess, said collet having a first end and a second end with an inner surface and an outer surface respectively extending therebetween, said inner surface of said collet defining said recess;

a plate attached to said second end of said collet;

a cylindrically shaped hollow sleeve having a first end and a second end with an inner wall extending therebetween, said second end of said sleeve being connected to said plate to surround said collet with said sleeve;

a retainer ring slidingly mounted on said inner wall of said sleeve for sliding contact with said outer surface of said collet;

a connector for thermally coupling said plate with said superconducting device; and means for pressing said refrigeration unit against said inner surface of said collet to cool said plate.

9. A coupling as recited in claim 8 wherein said retainer ring has an outer edge and an inner edge and is formed with a plurality of channels extending radially therethrough between said outer edge and said inner edge, and wherein said retainer ring further comprises a pair of juxtaposed counter-rotatable ball bearings, one said pair of ball bearings being rotatably mounted in each said channel of said retainer ring with one ball bearing extending beyond said outer edge of said retainer ring for contact with said inner wall of said sleeve and one ball bearing extending beyond said inner edge of said retainer ring for contact with said outer surface of said collet.

10. A coupling as recited in claim 9 further comprising a spring mechanism interconnecting said retainer ring with said sleeve for aligning said retainer ring on said inner wall of said sleeve.

11. A coupling as recited in claim 8 wherein said collet comprises a plurality of petals with each said petal being fixedly attached to said plate.

12. A coupling as recited in claim 8 wherein said refrigeration unit is formed with a tapered cooling probe and said recess of said collet is formed to receive said cooling probe therein.

13. A coupling as recited in claim 12 further comprising means attached to said refrigeration unit for engaging said refrigeration unit with said sleeve to urge said tapered cooling probe of said refrigeration unit into said recess of said collet with a predetermined force.

14. A coupling as recited in claim 12 wherein said tapered cooling probe is made of copper.

15. A coupling as recited in claim 12 wherein said collet is made of copper.

16. A coupling as recited in claim 12 wherein said tapered cooling probe and said inner surface of said collet are plated with a layer of indium.

17. A coupling as recited in claim 16 wherein said layer of indium is approximately one thousandth of an inch thick (0.001 inch).

18. A coupling as recited in claim 8 further comprising a bellows interconnecting said second end of said sleeve with said plate.

19. A method for cooling a superconductor device using a demountable thermal coupling which comprises the steps of:

connecting the demountable thermal coupling to the superconductor device, the coupling comprising a collet assembly formed with a recess, a sleeve assembly formed with a passageway for receiving the collet assembly therein and a retainer ring slidingly mounted between the collet assembly and the sleeve assembly, the connecting step being accomplished by attaching the superconductor device to the collet assembly of the coupling;

positioning a tapered cooling probe of a refrigeration unit in the recess of the collet assembly;

engaging the refrigeration unit with the sleeve assembly to generate a force therebetween; and adjusting the force between the refrigeration unit and the sleeve assembly to urge the cooling probe into the recess of the collet assembly to establish a thermal conduit between the refrigeration unit and the superconductor device through the collet assembly.

20. A method as recited in claim 19 wherein the tapered cooling probe and the collet assembly are made of copper and coated with a layer of indium, the indium layer being approximately one thousandth of an inch thick.

* * * * *